US012135029B2

(12) United States Patent
Sato et al.

(10) Patent No.: US 12,135,029 B2
(45) Date of Patent: Nov. 5, 2024

(54) SCROLL COMPRESSOR INCLUDING END-PLATE SIDE STEPPED PORTIONS OF EACH OF THE SCROLLS CORRESPONDING TO WALL-PORTION SIDE STEPPED PORTIONS OF EACH OF THE SCROLLS

(71) Applicant: MITSUBISHI HEAVY INDUSTRIES THERMAL SYSTEMS, LTD., Tokyo (JP)

(72) Inventors: Hajime Sato, Tokyo (JP); Takuma Yamashita, Tokyo (JP); Makoto Takeuchi, Tokyo (JP); Genta Yoshikawa, Tokyo (JP); Akihiro Kanai, Tokyo (JP); Kazuhide Watanabe, Aichi (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 17/710,378

(22) Filed: Mar. 31, 2022

(65) Prior Publication Data

US 2022/0220960 A1 Jul. 14, 2022

Related U.S. Application Data

(62) Division of application No. 15/551,621, filed as application No. PCT/JP2016/058314 on Mar. 16, 2016, now Pat. No. 11,326,602.

(30) Foreign Application Priority Data

Mar. 17, 2015 (JP) ..... 2015-053693

(51) Int. Cl.
*F04C 18/02* (2006.01)
*F04C 29/12* (2006.01)

(52) U.S. Cl.
CPC ..... *F04C 18/0276* (2013.01); *F04C 18/0215* (2013.01); *F04C 18/0253* (2013.01);
(Continued)

(58) Field of Classification Search
CPC ..... F04C 18/0276; F04C 18/0215; F04C 18/0253; F04C 18/0261; F04C 18/0284;
(Continued)

(56) References Cited

U.S. PATENT DOCUMENTS 4,457,674 A * 7/1984 Kawano ..... F04C 18/0276 418/5
4,477,238 A * 10/1984 Terauchi ..... F04C 18/0215 418/5

(Continued)

FOREIGN PATENT DOCUMENTS

CN 1383473 A 12/2002
JP 60-17956 B2 5/1985

(Continued)

OTHER PUBLICATIONS

International Search Report and Written Opinion of the International Searching Authority (Forms PCT/ISA/237 and PCT/ISA/210) for International Application No. PCT/JP2016/058314, dated Jun. 14, 2016, with English translations.

(Continued)

*Primary Examiner* — Deming Wan
*Assistant Examiner* — Paul W Thiede
(74) *Attorney, Agent, or Firm* — Birch, Stewart, Kolasch & Birch, LLP

(57) ABSTRACT

A scroll compressor with a stationary scroll, an orbiting scroll, and a discharge port through which a fluid that has been compressed by both the scrolls is discharged. An end plate of the orbiting scroll is provided with an end-plate side stepped portion formed such that, along a spiral of a spiral (Continued)

wrap, the height thereof increases toward a central side of the spiral and decreases toward an outer end side thereof. A spiral wrap of the stationary scroll is provided with a wall-portion side stepped portion formed corresponding to the end-plate side stepped portion such that the height thereof decreases toward the central side of the spiral and increases toward the outer end side thereof. A pair of compression chambers face each other. The ventral side compression chamber communicates with the discharge port before the dorsal side compression chamber communicates with the discharge port.

3 Claims, 9 Drawing Sheets

(52) U.S. Cl.
CPC ..... *F04C 18/0261* (2013.01); *F04C 18/0284* (2013.01); *F04C 29/12* (2013.01); *F04C 2240/10* (2013.01); *F04C 2240/20* (2013.01); *F04C 2250/301* (2013.01)

(58) Field of Classification Search
CPC .. F04C 29/12; F04C 2240/10; F04C 2240/20; F04C 2250/301
See application file for complete search history.

(56) References Cited

U.S. PATENT DOCUMENTS

| | | | | |
|---|---|---|---|---|
| 6,659,745 | B2 * | 12/2003 | Fujita | F04C 18/0276 418/55.4 |
| 7,335,004 | B2 * | 2/2008 | Lee | F04C 18/0276 417/310 |
| 8,678,796 | B2 * | 3/2014 | Kimata | F04C 18/0276 418/55.4 |
| 11,326,602 | B2 * | 5/2022 | Sato | F04C 18/0276 |
| 2002/0114720 | A1 | 8/2002 | Itoh et al. | |
| 2005/0053507 | A1 * | 3/2005 | Takeuchi | F04C 28/26 418/55.1 |
| 2006/0140804 | A1 | 6/2006 | Lee et al. | |
| 2009/0035167 | A1 * | 2/2009 | Sun | F04C 28/26 418/55.2 |
| 2010/0303661 | A1 * | 12/2010 | Kimata | F04C 18/0215 418/55.1 |
| 2017/0122317 | A1 * | 5/2017 | Sato | F04C 28/26 |

FOREIGN PATENT DOCUMENTS

| | | | | |
|---|---|---|---|---|
| JP | 4-121483 | A | 4/1992 | |
| JP | 4-255589 | A | 9/1992 | |
| JP | 8-21381 | A | 1/1996 | |
| JP | 2002-5052 | A | 1/2002 | |
| JP | 2002-70769 | A | 3/2002 | |
| JP | 2002-195174 | A | 7/2002 | |
| JP | 2006-177335 | A | 7/2006 | |
| JP | 2008-95637 | A | 4/2008 | |
| JP | 2014-145324 | A | 8/2014 | |
| WO | WO-2009150958 | A1 * | 12/2009 | F04C 18/0215 |

OTHER PUBLICATIONS

Office Action issued Apr. 5, 2021 in corresponding Japanese Patent Application No. 2020-012646 with an English Translation.
Office Action issued May 21, 2019 in related Japanese Patent Application No. 2015-053693.
Office Action issued Oct. 17, 2018 in corresponding Chinese Patent Application No. 201580015351.7.

* cited by examiner

SWIVEL ANGLE β2

SWIVEL ANGLE β1

SCROLL COMPRESSOR INCLUDING END-PLATE SIDE STEPPED PORTIONS OF EACH OF THE SCROLLS CORRESPONDING TO WALL-PORTION SIDE STEPPED PORTIONS OF EACH OF THE SCROLLS

This application is a Divisional of copending application Ser. No. 15/551,621, filed on Aug. 17, 2017, which is the National Phase under 35 U.S.C. § 371 of International Application No. PCT/JP2016/058314, filed on Mar. 16, 2016, which claims the benefit under 35 U.S.C. § 119(a) to Patent Application No. 2015-053693, filed in Japan on Mar. 17, 2015, all of which are hereby expressly incorporated by reference into the present application.

TECHNICAL FIELD

The present invention relates to three-dimensional compression-type scroll compressors.

BACKGROUND ART

A scroll compressor is provided with a pair of a stationary scroll and an orbiting scroll. The scrolls each include an end plate with a spiral wrap disposed in an upright manner thereon. The spiral wraps (spiral wall portions) of the pair of the stationary scroll and the orbiting scroll are opposed and engaged with each other with a 180 degree phase difference, thus forming a sealed compression chamber between the scrolls. As a result, the scroll compressor is configured to compress fluid. The above-discussed scroll compressor generally has a two-dimensional compression structure in which the wrap heights of the spiral wraps of the stationary scroll and the orbiting scroll are set to be constant over the entire circumference in the spiral direction, a compression chamber is made to move from the outer circumferential side to the inner circumferential side while having its capacity gradually reduced, and the fluid having been sucked into the compression chamber is compressed in the circumferential direction of the spiral wraps.

Meanwhile, in order to improve efficiency of the scroll compressor and to achieve downsizing and weight-reduction thereof, a three-dimensional compression-type scroll compressor has been provided. Such a three-dimensional compression-type scroll compressor has a structure in which a stepped portion is provided at a predetermined position, along the spiral direction, on each of the tooth crest and the tooth base of the spiral wraps of the stationary scroll and the orbiting scroll, such that the stepped portion forms a boundary at which the wrap height of the spiral wraps shifts from higher on the outer circumferential side to lower on the inner circumferential side. By causing the height of the compression chamber in the axial direction to be higher on the outer circumferential side of the spiral wraps than on the inner circumferential side thereof, the fluid is compressed both in the circumferential direction and in the height direction of the spiral wraps.

As such a three-dimensional compression-type scroll compressor, for example, a scroll compressor in which an end-plate side stepped portion is formed on an end plate of each of a stationary scroll and an orbiting scroll, and a wrap side stepped portion corresponding to the end-plate side stepped portion is provided on a spiral wrap of each of the stationary scroll and the orbiting scroll is well-known, as described in Patent Literature 1.

Further, as described in Patent Literature 2, a scroll compressor in which an end-plate side stepped portion is provided on an end plate of one of a stationary scroll and an orbiting scroll, and a wrap side stepped portion corresponding to the end-plate side stepped portion is formed on a spiral wrap of the other of the scrolls is well-known.

CITATION LIST

Patent Literature

Patent Literature 1: Japanese Unexamined Patent Application Publication No. 2002-5052A Patent Literature 2: Japanese Patent Publication No. 1985-17956B (See FIG. 8)

SUMMARY OF INVENTION

Technical Problems

As described in Patent Literature 1, in the case where the stepped portions are provided in both the stationary scroll and the orbiting scroll and these stepped portions have the same height, the stationary and orbiting scrolls are formed in the same shape. As such, because capacities of a pair of compression chambers facing each other on either side of the center of the stationary scroll are theoretically equal to each other at every swivel angle, the pressures in these compression chambers become the same.

However, in the case where the heights of the stepped portions of the stationary scroll and the orbiting scroll are different from each other, both the scrolls are not formed in the same shape. Accordingly, because the capacities of the pair of compression chambers facing each other on either side of the center of the stationary scroll are not always equal to each other at every swivel angle, the pressures in the compression chambers differ from each other.

Likewise, as described in Patent Literature 2, also in the case where an end-plate side stepped portion is provided on an end plate of one of the stationary scroll and the orbiting scroll, and a wrap side stepped portion corresponding to the end-plate side stepped portion is provided on a spiral wrap of the other of the scrolls, the stationary and orbiting scrolls are not formed in the same shape. Accordingly, because the capacities of the pair of compression chambers facing each other on either side of the center of the stationary scroll are not always equal to each other at every swivel angle, the pressures in the compression chambers differ from each other.

As discussed above, in the case where the pressures in the pair of compression chambers facing each other on either side of the center of the stationary scroll are different, one of the compression chambers is excessively compressed in some case, which causes a reduction in compression efficiency.

In particular, in an intermediate period like the spring when a low pressure ratio is required, overcompression noticeably occurs in one of the compression chambers.

Having been conceived in light of such circumstances, an object of the present invention is to provide a scroll compressor capable of preventing overcompression.

Solution to Problem

A scroll compressor of the present invention employs the following methods to solve the problems described above.

The scroll compressor according to the present invention is provided with a stationary scroll including a spiral wall portion erected on one side surface of an end plate, an orbiting scroll that includes a spiral wall portion erected on one side surface of an end plate and is supported so as to be capable of orbital revolution movement while being prevented from self-rotation by the wall portions being engaged with each other, and a discharge port through which a fluid that has been compressed by both the scrolls is discharged. On the one side of the end plate of one of the scrolls, there is provided an end-plate side stepped portion formed in such a way that, along a spiral of the wall portion, the height thereof increases toward a central side of the spiral and decreases toward an outer end side thereof; and on the other wall portion of the scrolls, there is provided a wall-portion side stepped portion formed corresponding to the end-plate side stepped portion in such a way that the height thereof decreases toward the central side of the spiral and increases toward the outer end side thereof. In the stated scroll compressor, of a pair of compression chambers facing each other on either side of the center of the stationary scroll, the compression chamber in which the pressure is higher communicates with the discharge port before the compression chamber in which the pressure is lower communicates with the discharge port.

In the case where the end-plate side stepped portion is provided in one of the stationary scroll and the orbiting scroll while the wall-portion side stepped portion is provided in the other of the scrolls, both the scrolls are not formed in the same shape.

Accordingly, the pressures in the pair of compression chambers facing each other on either side of the center of the stationary scroll are not the same. In the present invention, of the pair of compression chambers, the compression chamber in which the pressure is higher is made to communicate with the discharge port before the compression chamber in which the pressure is lower communicates with the discharge port. This makes it possible to avoid the overcompression.

For example, in the case where the end-plate side stepped portion is provided in the orbiting scroll and the wall-portion side stepped portion is provided in the stationary scroll, of the compression chambers facing each other against the wall portion of the stationary scroll, the compression chamber on a ventral side (inner circumferential side) is made to communicate with the discharge port earlier than the other one.

The scroll compressor according to the present invention is provided with a stationary scroll including a spiral wall portion erected on one side surface of an end plate, an orbiting scroll that includes a spiral wall portion erected on one side surface of an end plate and is supported so as to be capable of orbital revolution movement while being prevented from self-rotation by the wall portions being engaged with each other, and a discharge port through which a fluid that has been compressed by both the scrolls is discharged. On the one side surface of the end plate of each of the scrolls, there is provided an end-plate side stepped portion formed in such a way that, along a spiral of the wall portion, the height thereof increases toward a central side of the spiral and decreases toward an outer end side thereof; on the wall portion of each of the scrolls, there is provided a wall-portion side stepped portion formed corresponding to the end-plate side stepped portion in such a way that the height thereof decreases toward the central side of the spiral and increases toward the outer end side thereof; and the heights of the end-plate side stepped portion and the wall-portion side stepped portion corresponding to each other are different. In the stated scroll compressor, of a pair of compression chambers facing each other on either side of the center of the stationary scroll, the compression chamber in which the pressure is higher communicates with the discharge port before the compression chamber in which the pressure is lower communicates with the discharge port.

In the case where the end-plate side stepped portion is formed in each of the stationary scroll and the orbiting scroll, the wall-portion side stepped portion corresponding to the end-plate side stepped portion is formed on the wall portion of each of the stationary scroll and the orbiting scroll, and the heights of the end-plate side stepped portion and the wall-portion side stepped portion corresponding to each other are different, both the scrolls are not formed in the same shape.

Accordingly, the pressures in the pair of compression chambers facing each other on either side of the center of the stationary scroll are not the same. In the present invention, of the pair of compression chambers, the compression chamber in which the pressure is higher is made to communicate with the discharge port before the compression chamber in which the pressure is lower communicates with the discharge port. This makes it possible to avoid the overcompression.

For example, in the case where the end-plate side stepped portion of the orbiting scroll is larger in height than the wall-portion side stepped portion of the stationary scroll, of the compression chambers facing each other against the wall portion of the stationary scroll, the compression chamber on the ventral side (inner circumferential side) is made to communicate with the discharge port earlier than the other one.

The scroll compressor according to the present invention is provided with a stationary scroll including a spiral wall portion erected on one side surface of an end plate, an orbiting scroll that includes a spiral wall portion erected on one side surface of an end plate and is supported so as to be capable of orbital revolution movement while being prevented from self-rotation by the wall portions being engaged with each other, a discharge port through which a fluid that has been compressed by both the scrolls is discharged, and an extraction port for discharging a fluid with a pressure equal to or greater than a predetermined pressure before the fluid being discharged through the discharge port. On the one side surface of the end plate of one of the scrolls, there is provided an end-plate side stepped portion formed in such a way that, along a spiral of the wall portion, the height thereof increases toward a central side of the spiral and decreases toward an outer end side thereof; and on the wall portion of the other of the scrolls, there is provided a wall-portion side stepped portion formed corresponding to the end-plate side stepped portion in such a way that the height thereof decreases toward the central side of the spiral and increases toward the outer end side thereof. In the stated scroll compressor, of a pair of compression chambers facing each other on either side of the center of the stationary scroll, the compression chamber in which the pressure is higher communicates with the extraction port before the compression chamber in which the pressure is lower communicates with the extraction port.

In the case where the end-plate side stepped portion is provided in one of the stationary scroll and the orbiting scroll while the wall-portion side stepped portion is provided in the other of the scrolls, both the scrolls are not formed in the same shape.

Accordingly, the pressures in the pair of compression chambers facing each other on either side of the center of the stationary scroll are not the same. In the present invention, of the pair of compression chambers, the compression chamber in which the pressure is higher is made to communicate with the extraction port (what is called a bypass port) before the compression chamber in which the pressure is lower communicates with the extraction port. This makes it possible to avoid the overcompression.

For example, in the case where the end-plate side stepped portion is provided in the orbiting scroll and the wall-portion side stepped portion is provided in the stationary scroll, of the compression chambers facing each other against the wall portion of the stationary scroll, the compression chamber on the ventral side (inner circumferential side) is made to communicate with the extraction port earlier than the other one.

The scroll compressor according to the present invention is provided with a stationary scroll including a spiral wall portion erected on one side surface of an end plate, an orbiting scroll that includes a spiral wall portion erected on one side surface of an end plate and is supported so as to be capable of orbital revolution movement while being prevented from self-rotation by the wall portions being engaged with each other, a discharge port through which a fluid that has been compressed by both the scrolls is discharged, and an extraction port for discharging a fluid with a pressure equal to or greater than a predetermined pressure before the fluid being discharged through the discharge port. On the one side surface of the end plate of each of the scrolls, there is provided an end-plate side stepped portion formed in such a way that, along a spiral of the wall portion, the height thereof increases toward a central side of the spiral and decreases toward an outer end side thereof; on the wall portion of each of the scrolls, there is provided a wall-portion side stepped portion formed corresponding to the end-plate side stepped portion in such a way that the height thereof decreases toward the central side of the spiral and increases toward the outer end side thereof; and the height of the end-plate side stepped portion and the height of the wall-portion side stepped portion are different. In the stated scroll compressor, of a pair of compression chambers facing each other on either side of the center of the stationary scroll, the compression chamber in which the pressure is higher communicates with the extraction port before the compression chamber in which the pressure is lower communicates with the extraction port.

In the case where the end-plate side stepped portion is formed in each of the stationary scroll and the orbiting scroll, the wall-portion side stepped portion corresponding to the end-plate side stepped portion is formed on the wall portion of each of the stationary scroll and the orbiting scroll, and the heights of the end-plate side stepped portion and the wall-portion side stepped portion corresponding to each other are different, both the scrolls are not formed in the same shape.

Accordingly, the pressures in the pair of compression chambers facing each other on either side of the center of the stationary scroll are not the same. In the present invention, of the pair of compression chambers, the compression chamber in which the pressure is higher is made to communicate with the extraction port (what is called the bypass port) before the compression chamber in which the pressure is lower communicates with the extraction port. This makes it possible to avoid the overcompression.

For example, in the case where the end-plate side stepped portion of the orbiting scroll is larger in height than the wall-portion side stepped portion of the stationary scroll, of the compression chambers facing each other against the wall portion of the stationary scroll, the compression chamber on the ventral side (inner circumferential side) is made to communicate with the discharge port earlier than the other one.

Advantageous Effects of Invention

The overcompression can be prevented because the compression chamber in which the pressure is higher is made to communicate with the discharge port or the extraction port earlier than the other one.

DESCRIPTION OF EMBODIMENTS

Embodiments of the present invention will be described below with reference to the drawings.

First Embodiment

A first embodiment of the present invention will be described below, using FIGS. 1 to 5 and 9.

Figure 1:
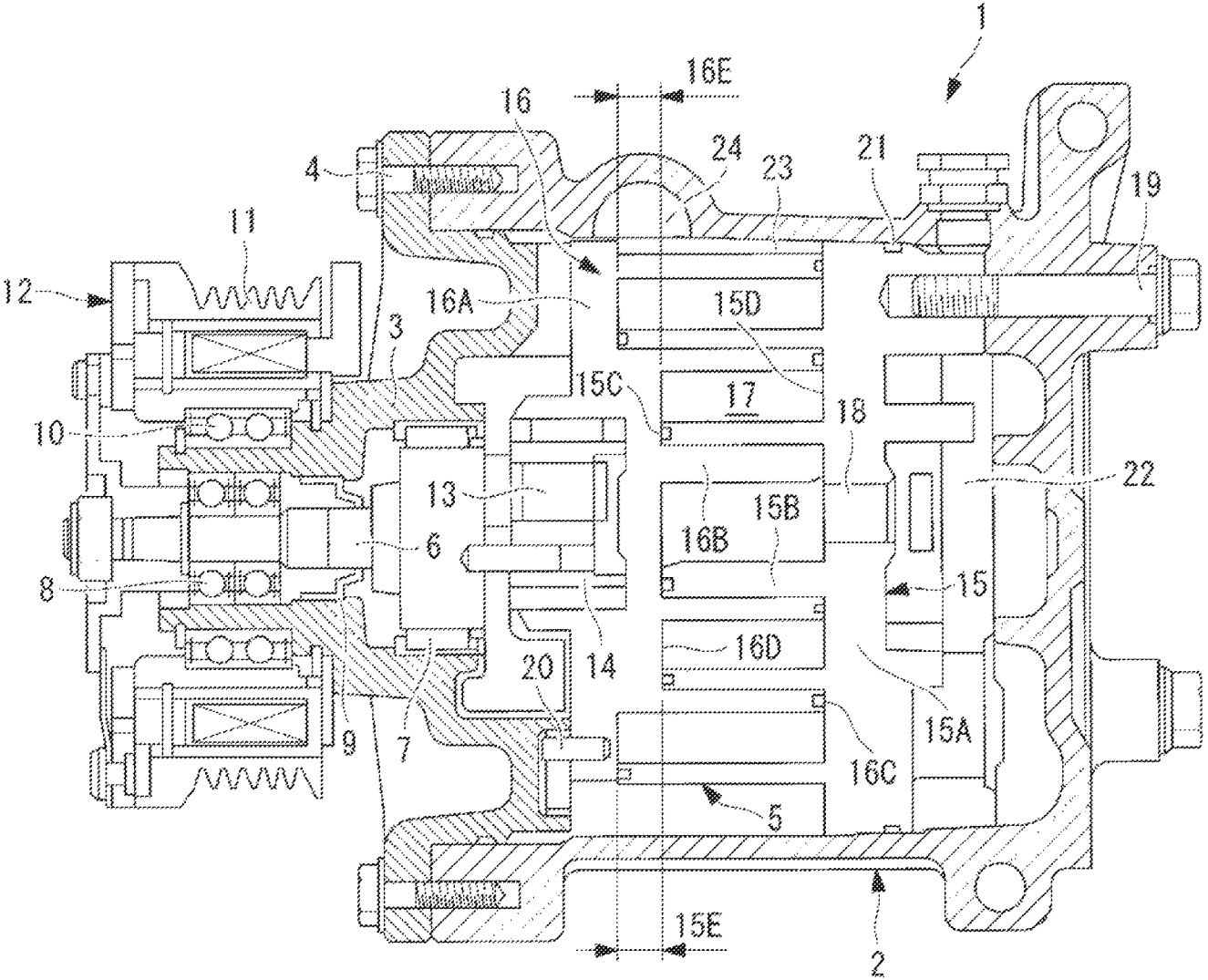
FIG. 1 is a vertical cross-sectional view of a scroll compressor according to a first embodiment of the present invention.

As illustrated in FIG. 1, a scroll compressor 1 includes a housing 2 constituting an outline. This housing 2 is a cylinder with an open front end side (left side in the drawing) and a sealed rear end side. By fastening and fixing a front housing 3 into the opening on the front end side using bolts 4, a sealed space is formed in the interior of the housing 2, and a scroll compression mechanism 5 and a drive shaft 6 are incorporated in the sealed space.

The drive shaft 6 is rotatably supported by the front housing 3 via a main bearing 7 and an auxiliary bearing 8. A pulley 11, which is rotatably provided on an outer circumferential portion of the front housing 3 via a bearing 10, is connected, via an electromagnetic clutch 12, to a front end portion of the drive shaft 6, which protrudes to the outside from the front housing 3 via a mechanical seal 9, such that motive power from outside can be transmitted. A crank pin 13, which is eccentric by a predetermined dimension, is integrally provided on the rear end of the drive shaft 6, and is connected to an orbiting scroll 16 of the scroll compression mechanism 5 described below, via a known slave crank mechanism 14 that includes a drive bushing having a variable turn radius and a drive bearing.

In the scroll compression mechanism 5, a pair of compression chambers 17, facing each other on either side of the center of a stationary scroll 15, are formed between the stationary scroll 15 and the orbiting scroll 16, as a result of a pair of the stationary and orbiting scrolls 15 and 16 being engaged with each other with a 180 degrees phase difference. The scroll compression mechanism 5 is configured to compress a fluid (a refrigerant gas) by moving each of the compression chambers 17 from an outer circumferential position to a center position while gradually reducing the capacity thereof.

A discharge port 18, which discharges compressed gas, is provided in a center section of the stationary scroll 15, and the stationary scroll 15 is fixedly provided on a bottom wall surface of the housing 2 via bolts 19. Further, the orbiting scroll 16 is connected to the crank pin 13 of the drive shaft 6 via the slave crank mechanism 14, and is supported by a thrust bearing surface of the front housing 3, via a known self-rotation prevention mechanism 20, such that the orbiting scroll 16 is freely capable of orbital revolution drive.

An O-ring 21 is provided around the outer circumference of an end plate 15A of the stationary scroll 15. As a result of the O-ring 21 making close contact with the inner circumferential surface of the housing 2, the internal space of the housing 2 is partitioned into a discharge chamber 22 and an intake chamber 23. The discharge port 18 opens into the discharge chamber 22. The compressed gas from the compression chambers 17 is discharged through the discharge port 18, and then discharged to a refrigeration cycle side therefrom.

Further, an intake port 24, which is provided in the housing 2, opens into the intake chamber 23. A low-pressure gas, which has circulated through the refrigeration cycle, is taken into the intake port 24, and then, the refrigerant gas is taken into the interior of the compression chambers 17 via the intake chamber 23.

Further, the pair of the stationary scroll 15 and the orbiting scroll 16 includes spiral wraps 15B and 16B disposed as wall portions in an upright manner on the end plate 15A and an end plate 16A, respectively. A tooth crest 15C of the stationary scroll 15 makes contact with a tooth base 16D of the orbiting scroll 16, and a tooth crest 16C of the orbiting scroll 16 makes contact with a tooth base 15D of the stationary scroll 15.

Figure 2:
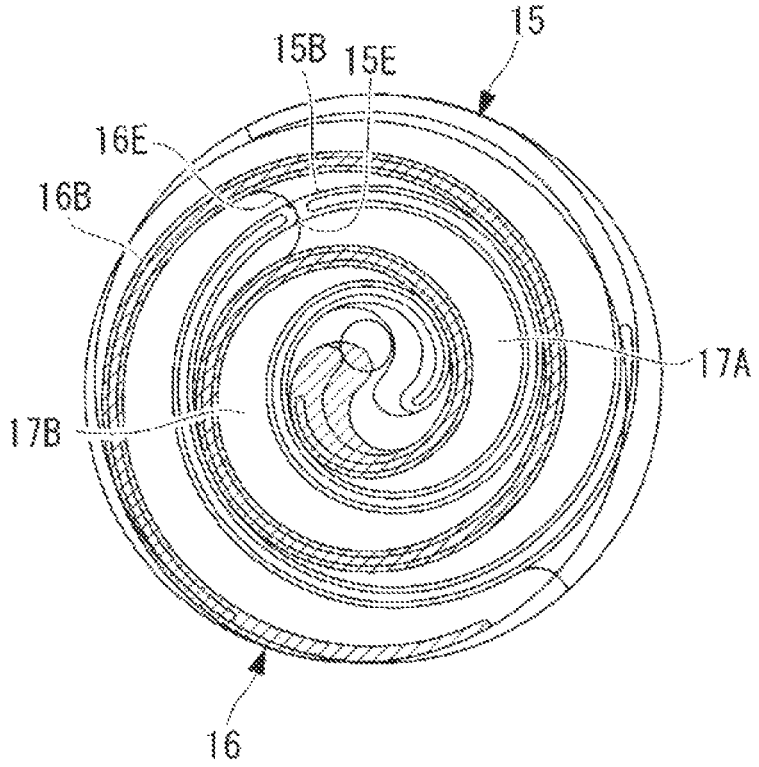
FIG. 2 is a horizontal cross-sectional view illustrating an engaged state of a stationary scroll and an orbiting scroll.

On the end plate 16A of the orbiting scroll 16, there is provided an end-plate side stepped portion 16E formed in such a way that, along a spiral of the spiral wrap 16B, the height thereof increases toward a central side of the spiral and decreases toward an outer end side thereof. To be specific, as illustrated in FIG. 2, the end-plate side stepped portion 16E is provided at a position of 180 degrees apart from a wrapping end position of the spiral wrap 16B of the orbiting scroll 16.

On the spiral wrap 15B of the stationary scroll 15, there is provided a wrap side stepped portion 15E corresponding to the end-plate side stepped portion 16E of the orbiting scroll 16 in such a way that the height thereof decreases toward the central side of the spiral and increases toward the outer end side thereof. To be specific, as illustrated in FIG. 2, the wrap side stepped portion 15E is provided at a position of 360 degrees apart from the wrapping end position of the spiral wrap 15B of the stationary scroll 15.

In other words, the end-plate side stepped portion 16E is provided only on the end plate 16A of the orbiting scroll 16, and the wrap side stepped portion 15E is provided only on the spiral wrap 15B of the stationary scroll 15. Accordingly, no stepped portion is provided on the spiral wrap 16B of the orbiting scroll 16, and a tip end of the spiral wrap 16B is leveled in height. Further, no stepped portion is provided on the end plate 15A of the stationary scroll 15 so the end plate 15A thereof has a flat surface.

Figure 9:
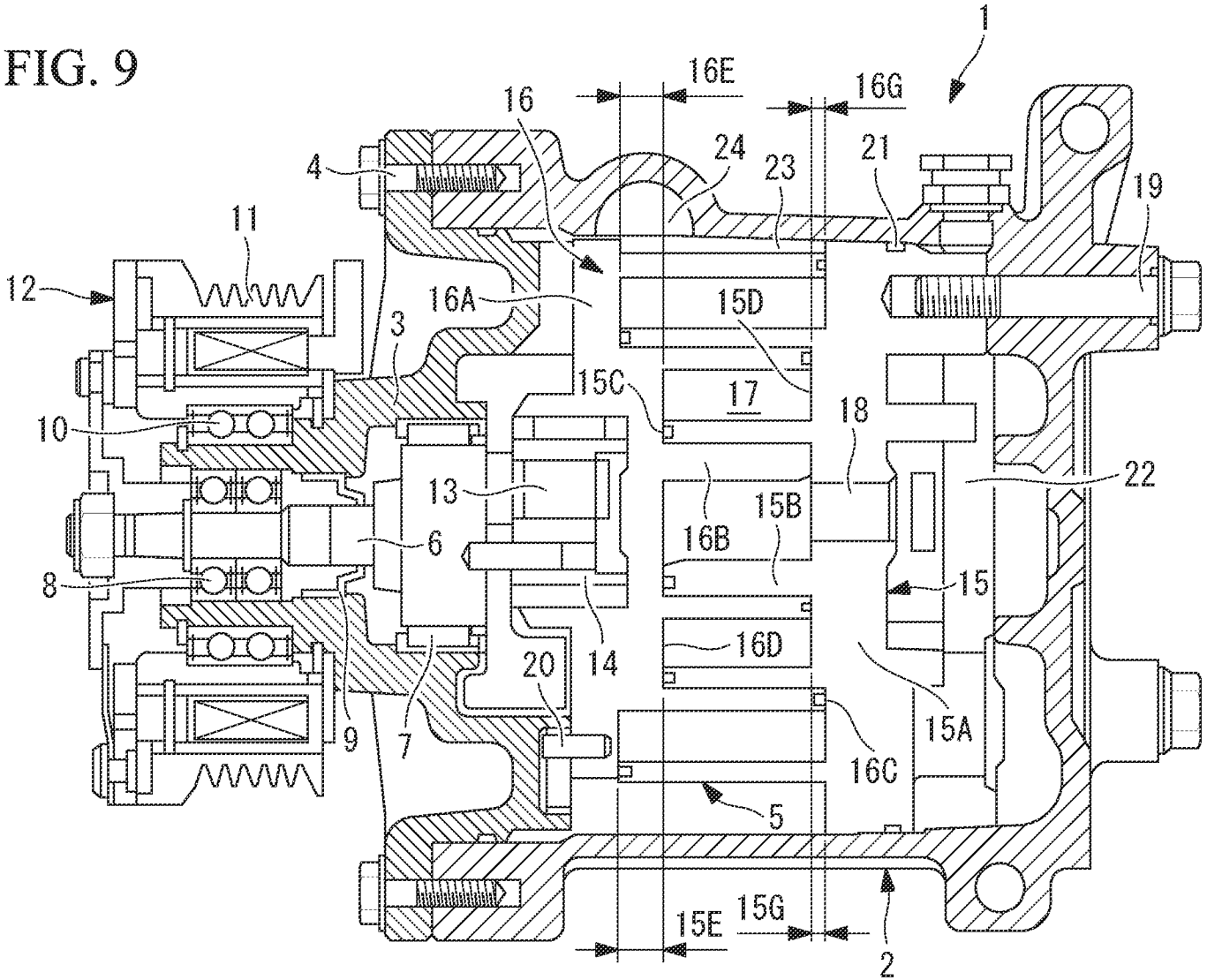
FIG. 9 illustrates a scroll compressor according to a first embodiment of the present invention.

FIG. 9 includes the stationary scroll 15 provided with an end-plate side stepped portion having a height lower than the end-plate side stepped portion 16E of the orbiting scroll 16, with respect to FIG. 1. FIG. 9 further includes an end plate side stepped portion 15G provided on the stationary scroll 15, and a wrap side stepped portion 16G provided on the orbiting scroll 16.

As illustrated in FIG. 2, the compression chambers 17 are formed of at least a pair of compression chambers 17A and 17B facing each other on either side of the center of the stationary scroll 15. In FIG. 2, in order to distinguish the pair of compression chambers 17A and 17B, the compression chamber formed on a ventral side (inner circumferential side) of the spiral wrap 15B of the stationary scroll 15 is defined as a ventral side compression chamber 17A while the compression chamber formed on a dorsal side (outer circumferential side) of the spiral wrap 15B of the stationary scroll 15 is defined as a dorsal side compression chamber 17B.

Figure 3:
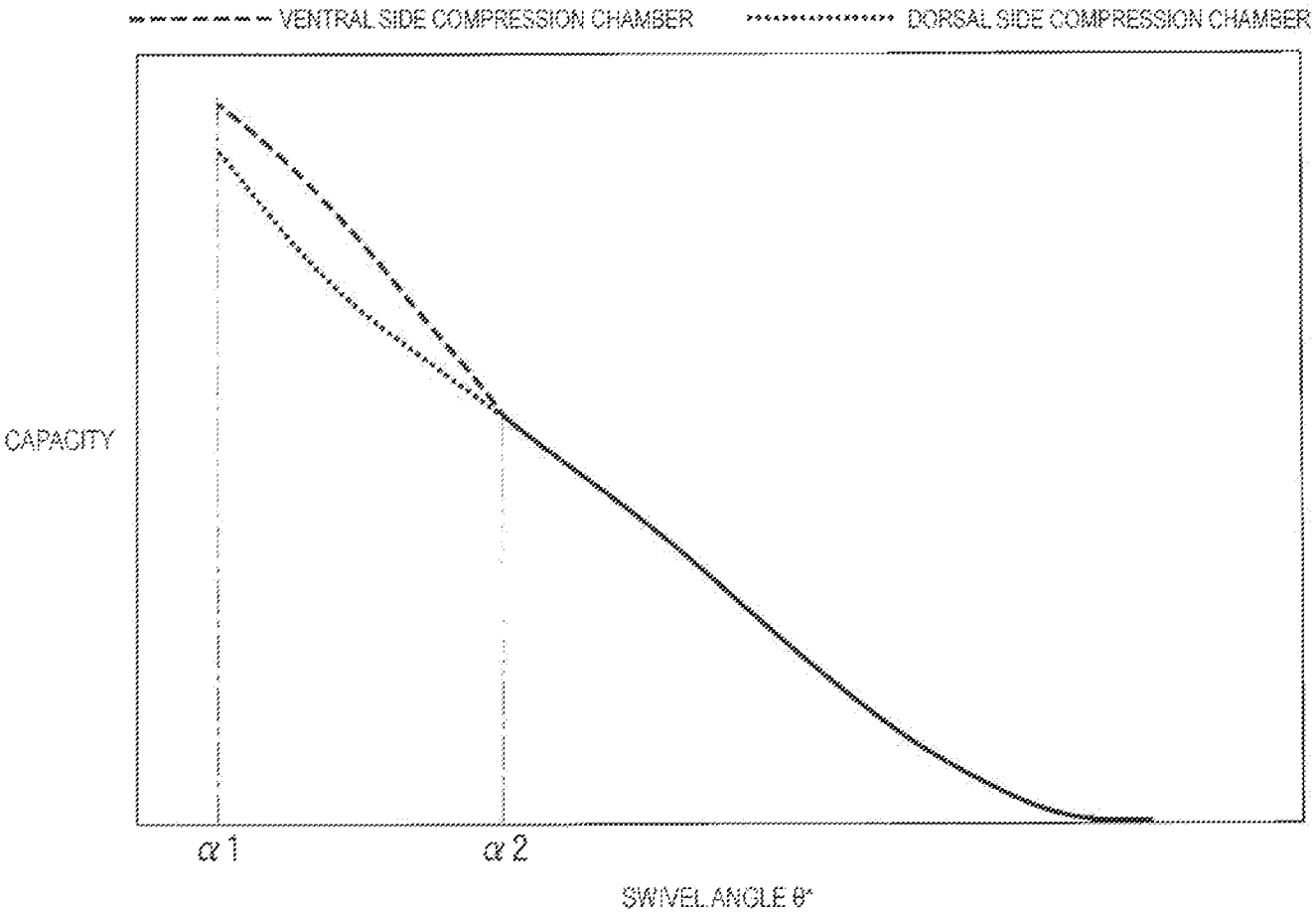
FIG. 3 is a graph showing changes in capacity of a ventral side compression chamber and a dorsal side compression chamber.

FIG. 3 shows changes in capacity of the ventral side compression chamber 17A and the dorsal side compression chamber 17B. In the graph, the horizontal axis represents a swivel angle $\theta^*$, and the vertical axis represents the capacity of the compression chambers 17A and 17B.

As can be understood from FIG. 3, after a pair of compression chambers is formed on the outermost circumferential side when the intake is ended at a swivel angle $\alpha 1$, the compression is performed from the above swivel angle, with the ventral side compression chamber 17A and the dorsal side compression chamber 17B having different capacity, up to a swivel angle $\alpha 2$, which is a swivel angle at which the ventral side and dorsal side compression chambers 17A and 17B have the same capacity and the fluid is discharged. Because a change rate (slant) of the capacity of the ventral side compression chamber 17A is larger than that of the dorsal side compression chamber 17B, the pressure in the ventral side compression chamber 17A becomes higher than that in the dorsal side compression chamber 17B, which raises a risk that an excessive discharge pressure may be brought about in the ventral side compression chamber 17A.

Figure 4A:
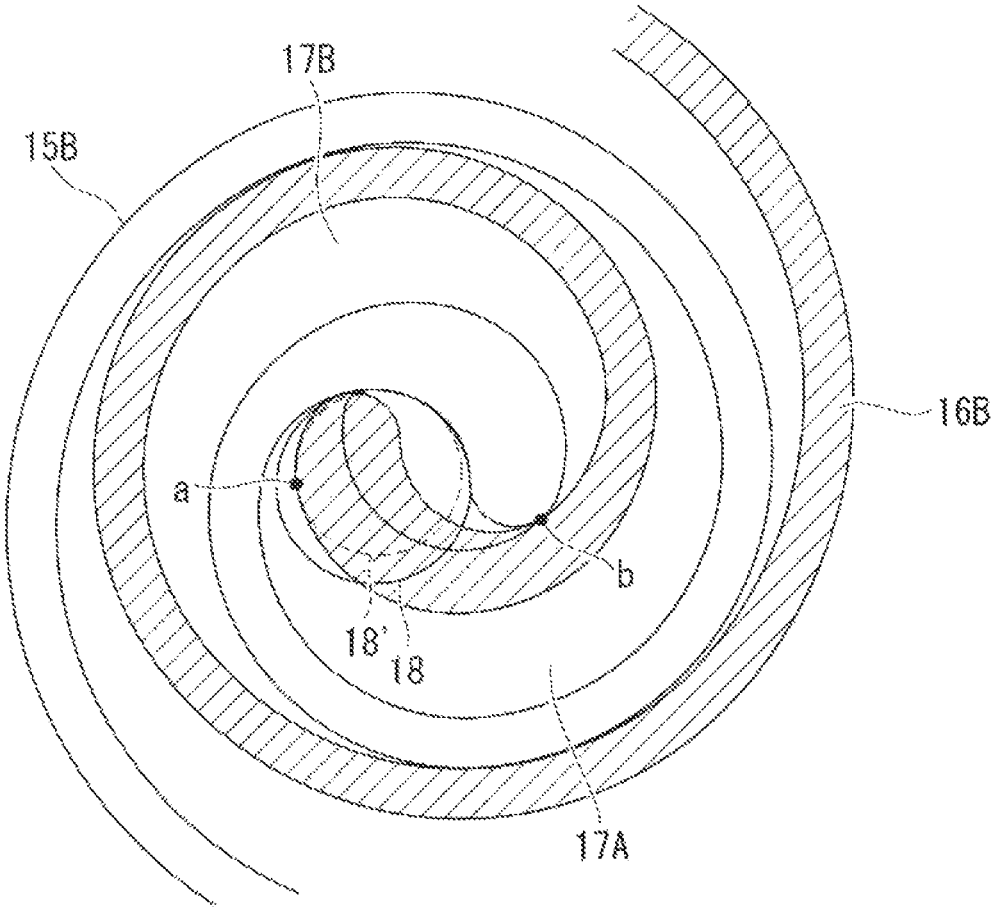
FIG. 4A is a horizontal cross-sectional view illustrating an engaged state of central portions of the stationary scroll and the orbiting scroll in an enlarged manner.
Figure 4B:
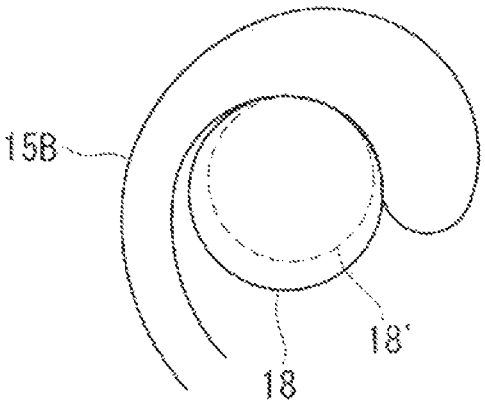
FIG. 4B is a horizontal cross-sectional view illustrating a position adjustment of a discharge port.

As such, in the present embodiment, as illustrated in FIGS. 4A and 4B, a shape of the discharge port 18 is adjusted so that the ventral side compression chamber 17A communicates with the discharge port 18 earlier than the dorsal side compression chamber 17B. As a method for adjusting the shape of the discharge port 18, it is sufficient that the discharge port 18 has a larger diameter than a diameter of a discharge port 18' adjusted so that the ventral side compression chamber 17A and the dorsal side compression chamber 17B open at the same time.

Positions a and b illustrated in the drawings indicate communication start points of the ventral side compression chamber 17A and the dorsal side compression chamber 17B, respectively, in a case of using the discharge port 18' adjusted so that the ventral side compression chamber 17A and the dorsal side compression chamber 17B open at the same time. As can be understood from the drawings, with the discharge port 18 having a larger diameter than the diameter of the discharge port 18' adjusted so that the ventral side compression chamber 17A and the dorsal side compression chamber 17B open at the same time, the ventral side compression chamber 17A communicates with the discharge port 18 earlier than the dorsal side compression chamber 17B.

Figure 4C:
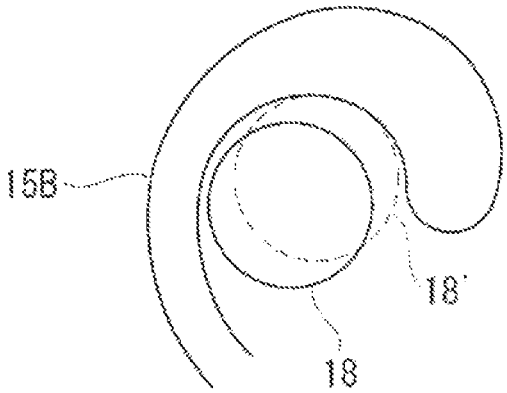
FIG. 4C is a horizontal cross-sectional view illustrating a position adjustment of a discharge port as a variation.

As another method for adjusting the shape of the discharge port 18, as illustrated in FIG. 4C, the discharge port 18 may have the same diameter as that of the discharge port 18' adjusted so that the ventral side compression chamber 17A and the dorsal side compression chamber 17B open at the same time, and a center position thereof may be moved toward the ventral side compression chamber 17A side, that is, toward an outer side (left side in the drawing) of the wrapping of the spiral wrap 15B of the stationary scroll 15. Alternatively, a cross section of the discharge port 18 may not have a circular shape but have a shape such as an elliptical shape or a keyhole shape, so that the discharge port 18 may communicate earlier with the ventral side compression chamber 17A.

According to the scroll compressor 1 of the present embodiment, it is possible to obtain the following effects.

Of the pair of the compression chambers 17A and 17B facing each other on either side of the center of the stationary scroll 15, the ventral side compression chamber 17A in which the pressure is higher is made to communicate with the discharge port earlier than the dorsal side compression chamber 17B in which the pressure is lower.

With this, even if the scroll compressor 1 is configured such that the stepped portion 16E is provided on the end plate 16A of the orbiting scroll 16, the stepped portion 15E corresponding to the stepped portion 16E is provided on the spiral wrap 15B of the other scroll, that is, the stationary scroll 15, and the pressures in the pair of the compression chambers 17A and 17B facing each other on either side of the center of the stationary scroll 15 are not the same, thus, the overcompression of the ventral side compression chamber 17A can be avoided.

Figure 5:
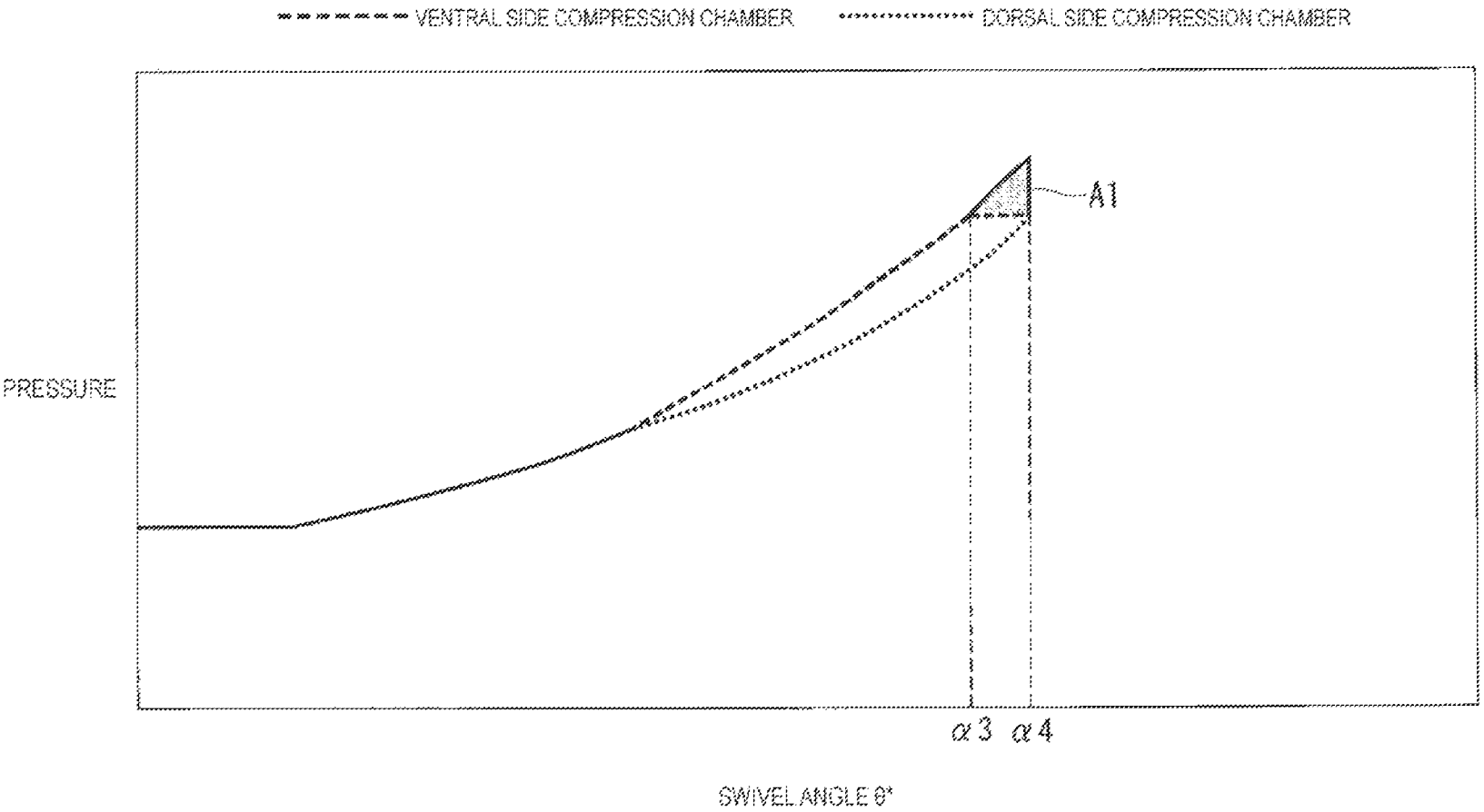
FIG. 5 is a graph showing changes in capacity of the ventral side compression chamber and the dorsal side compression chamber according to the first embodiment.

To be specific, as shown in FIG. 5, because the ventral side compression chamber 17A communicates with the discharge port 18 at a swivel angle $\alpha 3$ before a swivel angle $\alpha 4$ at which the dorsal side compression chamber 17B communicates with the discharge port 18, the ventral side compression chamber 17A is not further compressed after the swivel angle $\alpha 3$. With this, it can be avoided that energy corresponding to a substantially triangular region A1 shown in FIG. 5 becomes motive power loss and reduces the compression efficiency.

The description of the present embodiment is given using the configuration in which the end-plate side stepped portion 16E is provided only on the end plate 16A of the orbiting scroll 16, and the wrap side stepped portion 15E is provided only on the spiral wrap 15B of the stationary scroll 15. However, a configuration in which the above constituent elements are provided in a reversed manner may be used.

In other words, the present invention can be also applied to the configuration in which the end-plate side stepped portion is provided only on the end plate 15A of the stationary scroll 15, and the wrap side stepped portion is provided only on the spiral wrap 16B of the orbiting scroll 16.

In this case, because the pressure in the dorsal side compression chamber 17B becomes higher than that in the ventral side compression chamber 17A, the configuration should be such that the dorsal side compression chamber 17B communicates with the discharge port 18 earlier than the ventral side compression chamber 17A. For example, in FIG. 4A, a notch, a groove, or the like is provided on the ventral side of the spiral wrap 16B of the orbiting scroll 16 so that a gap is generated earlier at the position b.

The present invention can be also applied to a scroll compressor in which end-plate side stepped portions are provided on end plates of both a stationary scroll and an orbiting scroll as explained using Patent Literature 1.

That is, in the case where the height of the end-plate side stepped portion provided on the end plate of the orbiting scroll is larger than that of the end-plate side stepped portion provided on the end plate of the stationary scroll, because, like in the present embodiment, the pressure in the ventral side compression chamber 17A becomes higher than that in the dorsal side compression chamber 17B, adjusting the shape of the discharge port makes it possible to avoid the overcompression of the ventral side compression chamber 17A.

On the other hand, in the case where the height of the end-plate side stepped portion provided on the end plate of the stationary scroll is larger than that of the end-plate side stepped portion provided on the end plate of the orbiting scroll, because the pressure in the dorsal side compression chamber 17B becomes higher than that in the ventral side compression chamber 17A, providing a notch, a groove, or the like on the ventral side of the spiral wrap 16B of the orbiting scroll 16 makes it possible to avoid the overcompression of the dorsal side compression chamber 17B.

Second Embodiment

Next, a second embodiment of the present invention will be described with reference to FIG. 6A to FIG. 8.

The present embodiment differs from the first embodiment in a point that a bypass port is provided in addition to the configuration of the first embodiment. As such, same configurations as those in the first embodiment are given the same reference signs, and explanations thereof are omitted.

Figure 6B:
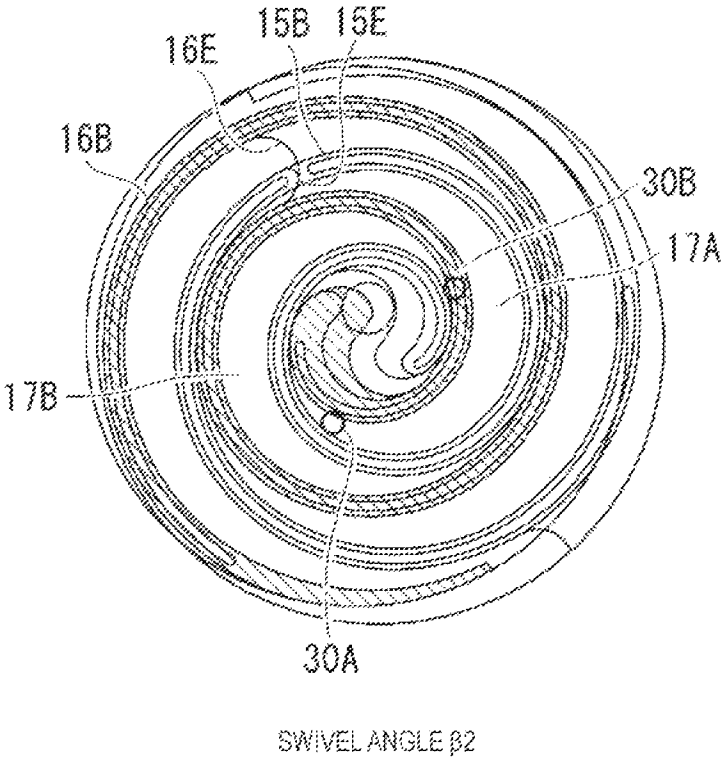
FIG. 6A and FIG. 6B are horizontal cross-sectional views each illustrating an engaged state of a stationary scroll and an orbiting scroll according to a second embodiment.
Figure 6A:
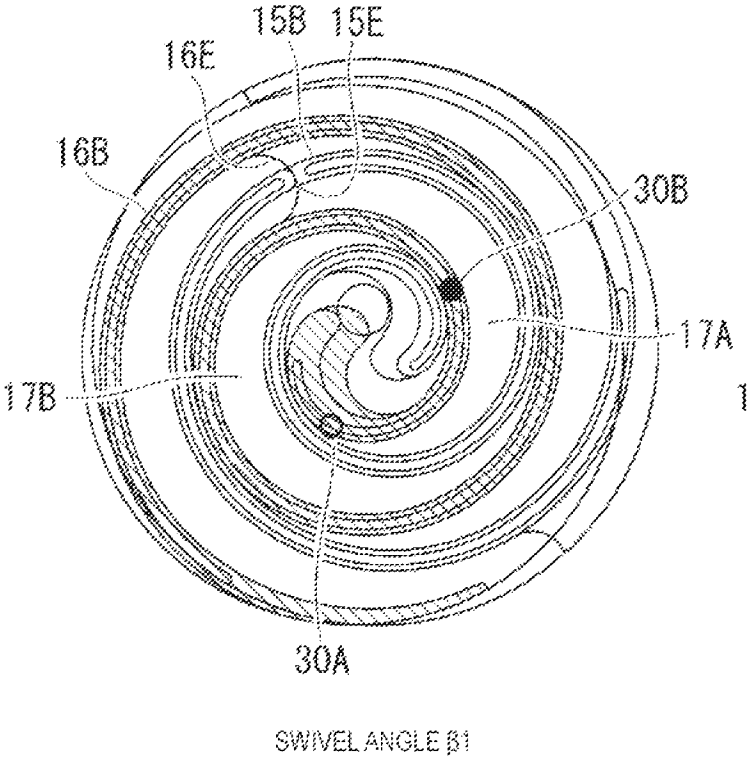

A scroll compressor 1 of the present embodiment has a vertical cross-sectional shape as illustrated in FIG. 1. In addition, in the scroll compressor 1 of the present embodiment, as illustrated in FIGS. 6A and 6B, bypass ports (extraction ports) 30A and 30B are formed in the end plate 15A of the stationary scroll 15. The bypass ports 30A and 30B each include a check valve or the like, where the valve opens when the pressure becomes equal to or greater than a predetermined one. A fluid with a pressure equal to or greater than the predetermined one is discharged through the bypass ports before the fluid is discharged through the discharge port 18, thereby avoiding the overcompression. In FIGS. 6A and 6B, one bypass port 30A corresponds to the ventral side compression chamber 17A, and the other bypass port, that is, the bypass port 30B corresponds to the dorsal side compression chamber 17B.

In the present embodiment, as illustrated in FIG. 6A, at a swivel angle $\beta 1$, the ventral side compression chamber 17A communicates with the bypass port 30A while the dorsal side compression chamber 17B does not communicate with the bypass port 30B. Accordingly, at the swivel angle $\beta 1$, an amount of fluid corresponding to an excessive pressure is extracted only from the ventral side compression chamber 17A. Then, as illustrated in FIG. 6B, when having advanced to a swivel angle $\beta 2$, the dorsal side compression chamber 17B communicates with the bypass port 30B. At the swivel angle $\beta 2$, the ventral side compression chamber 17A has already communicated with the bypass port 30A.

Figure 7B:
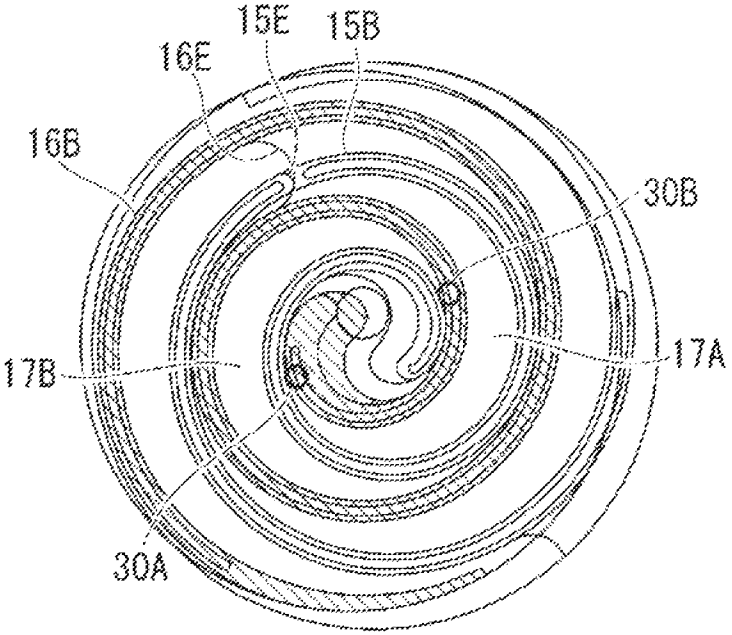
FIG. 7A and FIG. 7B are horizontal cross-sectional views each illustrating an engaged state of a stationary scroll and an orbiting scroll as a comparative example.
Figure 7A:
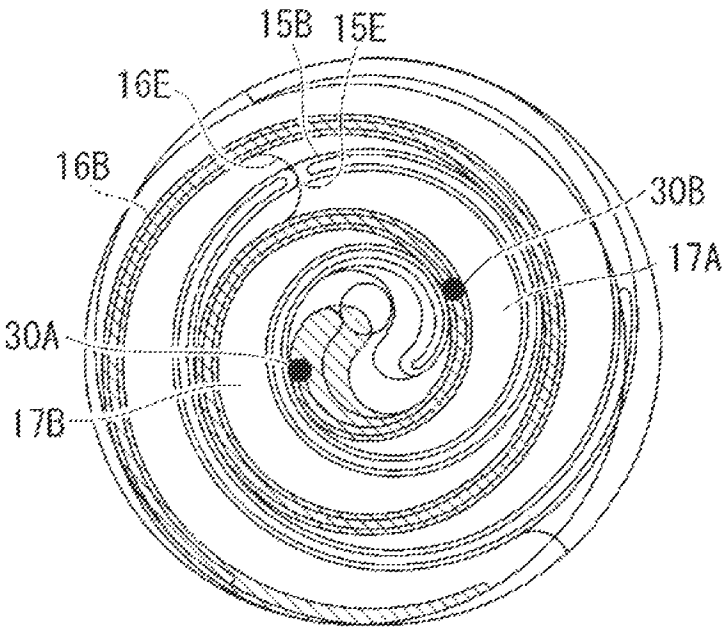

FIGS. 7A and 7B illustrate communication start timings of the bypass ports as a comparative example. The configuration of this comparative example corresponds to a case in which a pressure differential between the ventral side compression chamber 17A and the dorsal side compression chamber 17B is substantially zero, or is small so as not to affect the performance. As illustrated in FIG. 7A, none of the bypass ports 30A and 30B communicate with the compression chambers 17A and 17B at the swivel angle β1; as illustrated in FIG. 7B, at the swivel angle β2, the compression chambers 17A and 17B communicate with the bypass ports 30A and 30B at the same time.

Figure 8:
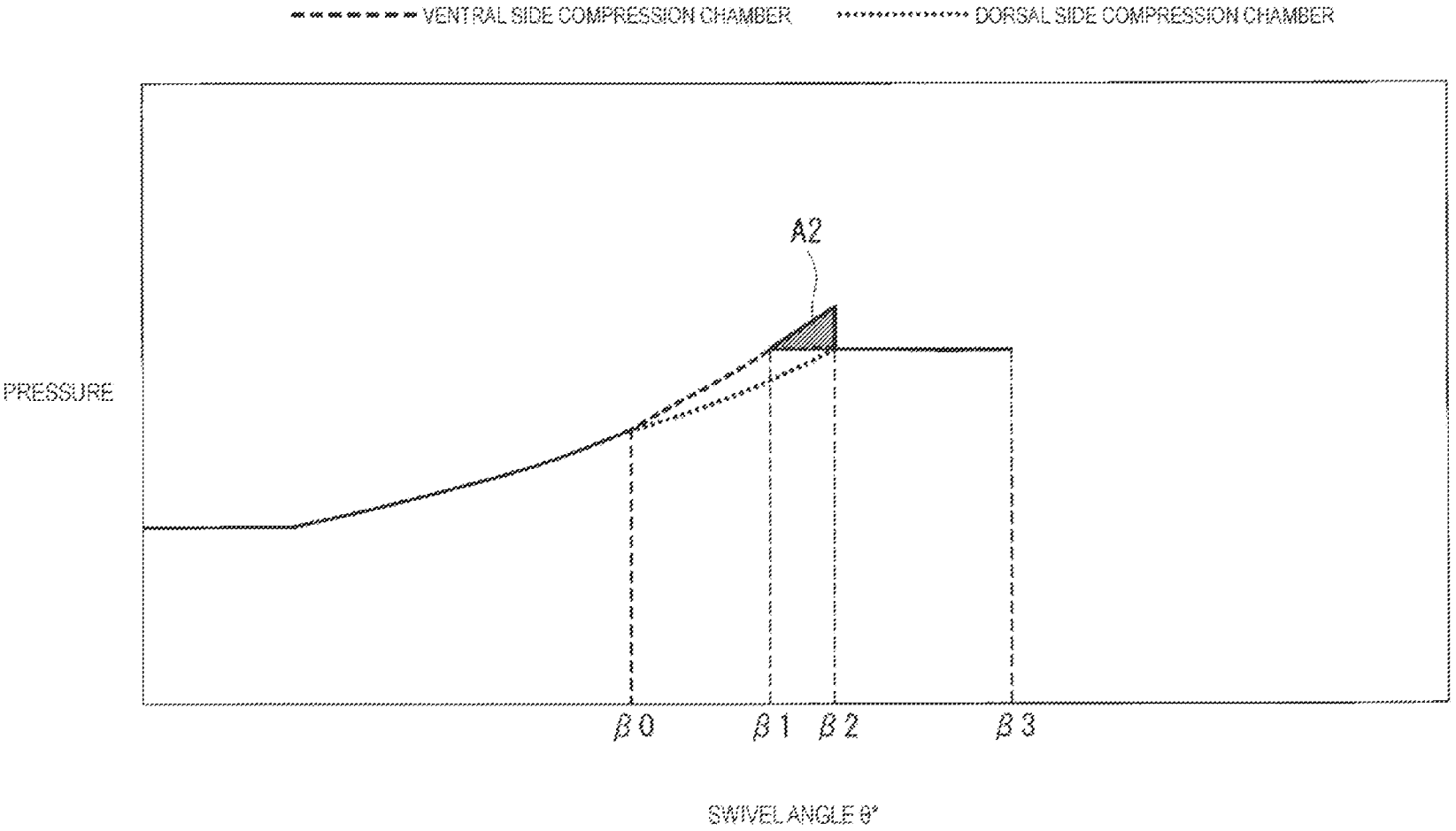
FIG. 8 is a graph showing changes in capacity of a ventral side compression chamber and a dorsal side compression chamber according to the second embodiment.

FIG. 8 shows pressure changes due to the bypass ports 30A and 30B of the present embodiment illustrated in FIGS. 6A and 6B. In the graph, the horizontal axis represents the swivel angle, and the vertical axis represents the pressure. As can be understood from the graph, the pressure in the ventral side compression chamber 17A becomes higher than that in the dorsal side compression chamber 17B from around a swivel angle β0.

Then, as illustrated in FIG. 6A, at the swivel angle β1, the ventral side compression chamber 17A starts communicating with the bypass port 30A, and is not excessively compressed to a pressure equal to or greater than a requested discharge pressure. Thereafter, as illustrated in FIG. 6B, at the swivel angle β2, the dorsal side compression chamber 17B starts communicating with the bypass port 30B, and is adjusted to the requested discharge pressure until at a swivel angle β3 at which the compression chamber communicates with the discharge port 18.

In contrast, in the case where both the compression chambers 17A and 17B start communicating with the bypass ports 30A and 30B at the same time at the swivel angle β2, as illustrated in FIGS. 7A and 7B, the ventral side compression chamber 17A is excessively compressed to a pressure equal to or greater than the requested discharge pressure as shown in FIG. 8. Accordingly, energy corresponding to a substantially triangular region A2 shown in FIG. 8 becomes motive power loss and reduces the compression efficiency.

According to the scroll compressor 1 of the present embodiment, it is possible to obtain the following effects.

Of the pair of the compression chambers 17A and 17B facing each other on either side of the center of the stationary scroll 15, the ventral side compression chamber 17A in which the pressure is higher is made to communicate with the bypass port 30A earlier than the dorsal side compression chamber 17B in which the pressure is lower.

With this, even if the scroll compressor 1 is configured such that the stepped portion 16E is provided on the end plate 16A of the orbiting scroll 16, the spiral wrap 15B of the other scroll, that is, the stationary scroll 15 includes a shape of the stepped portion 15E corresponding to the stepped portion 16E, and the pressures in the pair of the compression chambers 17A and 17B facing each other on either side of the center of the stationary scroll 15 are not the same, the overcompression of the ventral side compression chamber 17A can be avoided.

In the present embodiment, such a configuration is assumed that the end-plate side stepped portion 16E is provided only on the end plate 16A of the orbiting scroll 16, and the wrap side stepped portion 15E is provided only on the spiral wrap 15B of the stationary scroll 15. However, a configuration in which the above constituent elements are provided in a reversed manner may be employed.

In other words, the present invention can be also applied to the configuration in which the end-plate side stepped portion is provided only on the end plate 15A of the stationary scroll 15, and the wrap side stepped portion is provided only on the spiral wrap 16B of the orbiting scroll 16.

In this case, because the pressure in the dorsal side compression chamber 17B becomes higher than that in the ventral side compression chamber 17A, the position of the bypass port 30B is adjusted so that the dorsal side compression chamber 17B communicates with the bypass port 30B earlier than the ventral side compression chamber 17A.

The present invention can be also applied to a scroll compressor as shown in FIG. 9 in which end-plate side stepped portions are provided on end plates of both a stationary scroll and an orbiting scroll as explained using Patent Literature 1.

That is, in the case where the height of the end-plate side stepped portion provided on the end plate of the orbiting scroll is larger than that of the end-plate side stepped portion provided on the end plate of the stationary scroll, because, like in the present embodiment, the pressure in the ventral side compression chamber 17A becomes higher than that in the dorsal side compression chamber 17B, providing the fixed position of the bypass port 30A, so that the ventral side compression chamber 17A communicates with the bypass port 30*a* before the dorsal side compression chamber 17B communicates with the bypass port 30B, makes it possible to avoid the overcompression of the ventral side compression chamber 17A.

On the other hand, in the case where the height of the end-plate side stepped portion provided on the end plate of the stationary scroll is larger than that of the end-plate side stepped portion provided on the end plate of the orbiting scroll, because the pressure in the dorsal side compression chamber 17B becomes higher than that in the ventral side compression chamber 17A, providing the fixed position of the bypass port 30B, so that the dorsal side compression chamber 17B communicates with the bypass port 30B before the ventral side compression chamber 17A communicated with the bypass port 30A makes it possible to avoid the overcompression of the dorsal side compression chamber 17B.

REFERENCE SIGNS LIST

1 Scroll compressor
15 Stationary scroll
16 Orbiting scroll
15A, 16A End plate
15B, 16B Spiral wrap
15C, 16C Tooth crest
15D, 16D Tooth base
15E Wrap side stepped portion (Wall-portion side stepped portion)
16E End-plate side stepped portion
17 Compression chamber
17A Ventral side compression chamber
17B Dorsal side compression chamber
30A, 30B Bypass port (Extraction port)

The invention claimed is:

1. A scroll compressor comprising:

a stationary scroll including a spiral wall portion erected on one side surface of an end plate;

an orbiting scroll that includes a spiral wall portion erected on one side surface of an end plate and is supported so as to perform orbital revolution movement while being prevented from self-rotation by the respective spiral wall portions being engaged with each other; and a discharge port through which compressed fluid is discharged;

a single end-plate side stepped portion being provided on a one side surface of the end plate of the orbiting scroll, the single end-plate side stepped portion being formed so that, along the spiral wall portion of the one of the orbiting scroll, a height of the single end-plate side stepped portion increases toward a central side of the spiral wall portion of the orbiting scroll and decreases toward an outer end side of the spiral wall portion of the one of the orbiting scroll;

a single wall-portion side stepped portion being provided on the spiral wall portion of the stationary scroll, the single wall-portion side stepped portion being formed corresponding to the single end-plate side stepped portion of the orbiting scroll so that a height of the single wall-portion side stepped portion decreases toward the central side of the spiral wall portion of the stationary scroll and increases toward the outer end side of the spiral wall portion of the stationary scroll, the single wall-portion side stepped portion corresponding to the single end-plate side stepped portion;

a pair of compression chambers including a first compression chamber and a second compression chamber being formed between the stationary scroll and the orbiting scroll during a portion of a cycle of the orbital revolution movement after intake has ended, a capacity change rate of the first compression chamber is made different from a capacity change rate of the second compression chamber by the single end-plate side stepped portion and the single wall-portion side stepped portion during the portion of the cycle of the orbital revolution movement so that pressure in the first compression chamber is made higher than pressure in the second compression chamber at a swivel angle at which the fluid is discharged;

a first extraction port that is provided to communicate with the first compression chamber and discharges a fluid with a pressure equal to or greater than a predetermined pressure before the fluid being discharged through the discharge port; and a second extraction port that is provided to communicate with the second compression chamber and discharges a fluid with a pressure equal to or greater than a predetermined pressure before the fluid being discharged through the discharge port, wherein during the portion of the cycle of the orbital revolution movement after the intake has ended, the first compression chamber in which the pressure is made higher communicates with the first extraction port before the second compression chamber in which the pressure is made lower communicates with the second extraction port.

2. A scroll compressor comprising:

a stationary scroll including a spiral wall portion erected on one side surface of an end plate;

an orbiting scroll that includes a spiral wall portion erected on one side surface of an end plate and is supported so as to perform orbital revolution movement while being prevented from self-rotation by the respective spiral wall portions being engaged with each other; and a discharge port through which compressed fluid is discharged;

an end-plate side stepped portion being provided on a one side surface of the end plate of each of the stationary scroll and the orbiting scroll, the end-plate side stepped portion being formed so that, along the spiral wall portion of each of the stationary scroll and the orbiting scroll, a height of the end-plate side stepped portion increases toward a central side of the spiral wall portion of each of the stationary scroll and the orbiting scroll and decreases toward an outer end side of the spiral wall portion of each of the stationary scroll and the orbiting scroll;

a wall-portion side stepped portion being provided on the spiral wall portion of each of the stationary scroll and the orbiting scroll, the wall-portion side stepped portion for the stationary scroll being formed corresponding to the end-plate side stepped portion for the orbiting scroll so that a height of the wall-portion side stepped portion for the stationary scroll decreases toward the central side of the spiral wall portion of the stationary scroll and increases toward the outer end side of the spiral wall portion of the stationary scroll, and the wall-portion side stepped portion for the orbiting scroll being formed corresponding to the end-plate side stepped portion for the stationary scroll so that a height of the wall-portion side stepped portion for the orbiting scroll decreases toward the central side of the spiral wall portion of the orbiting scroll and increases toward the outer end side of the spiral wall portion of the orbiting scroll;

the height of the end-plate side stepped portion of one of the stationary scroll or the orbiting scroll being higher than the height of the end-plate side stepped portion of the other of the stationary scroll or the orbiting scroll;

a pair of compression chambers including a first compression chamber and a second compression chamber being formed between the stationary scroll and the orbiting scroll during a portion of a cycle of the orbital revolution movement after intake has ended, a capacity change rate of the first compression chamber is made different from a capacity change rate of the second compression chamber by the end-plate side stepped portion and the wall side stepped portion during the portion of the cycle of the orbital revolution movement so that pressure in the first compression chamber is made higher from pressure in the second compression chamber at a swivel angle at which the fluid is discharged;

a first extraction port that is provided to communicate with the first compression chamber and discharges a fluid with a pressure equal to or greater than a predetermined pressure before the fluid being discharged through the discharge port; and a second extraction port that is provided to communicate with the second compression chamber and discharges a fluid with a pressure equal to or greater than a predetermined pressure before the fluid being discharged through the discharge port;

wherein during the portion of the cycle of the orbital revolution movement after the intake has ended, the first compression chamber in which the pressure is made higher communicates with the first extraction port before the second compression chamber in which the pressure is made lower communicates with the second extraction port.

3. A scroll compressor comprising:

a stationary scroll including a spiral wall portion erected on one side surface of an end plate;

an orbiting scroll that includes a spiral wall portion erected on one side surface of an end plate and is supported so as to perform orbital revolution movement while being prevented from self-rotation by the respective spiral wall portions being engaged with each other; and a discharge port through which compressed fluid is discharged;

a single end-plate side stepped portion being provided on a one side surface of the end plate of the stationary scroll, the single end-plate side stepped portion being formed so that, along the spiral wall portion of the stationary scroll, a height of the single end-plate side stepped portion increases toward a central side of the spiral wall portion of the stationary scroll and decreases toward an outer end side of the spiral wall portion of the stationary scroll;

a single wall-portion side stepped portion being provided on the spiral wall portion of the orbiting scroll, the single wall-portion side stepped portion being formed corresponding to the single end-plate side stepped portion of the stationary scroll so that a height of the single wall-portion side stepped portion decreases toward the central side of the spiral wall portion of the orbiting scroll and increases toward the outer end side of the spiral wall portion of the orbiting scroll, the single wall-portion side stepped portion corresponding to the single end-plate side stepped portion;

a pair of compression chambers including a first compression chamber and a second compression chamber being formed between the stationary scroll and the orbiting scroll during a portion of a cycle of the orbital revolution movement after intake has ended, a capacity change rate of the first compression chamber is made different from a capacity change rate of the second compression chamber by the single end-plate side stepped portion and the single wall-portion side stepped portion during the portion of the cycle of the orbital revolution movement so that pressure in the second compression chamber is made higher than pressure in the first compression chamber at a swivel angle at which the fluid is discharged;

a first extraction port that is provided to communicate with the first compression chamber and discharges a fluid with a pressure equal to or greater than a predetermined pressure before the fluid being discharged through the discharge port; and a second extraction port that is provided to communicate with the second compression chamber and discharges a fluid with a pressure equal to or greater than a predetermined pressure before the fluid being discharged through the discharge port, wherein during the portion of the cycle of the orbital revolution movement after the intake has ended, the second compression chamber in which the pressure is made higher communicates with the second extraction port before the first compression chamber in which the pressure is made lower communicates with the first extraction port.

* * * * *